US008393334B2

(12) United States Patent
Cecchetto et al.

(10) Patent No.: US 8,393,334 B2
(45) Date of Patent: Mar. 12, 2013

(54) SMOKING ARTICLE WITH TRANSPARENT SECTION

(75) Inventors: Andrea Cecchetto, Liebfeld (CH); Frédéric Chapuis, Chez-le-Bart (CH); Marco Presello, Boveresse (CH); Kuersteiner Charles, Jouxtens (CH)

(73) Assignee: Philip Morris USA Inc., Richmond, VA (US)

( * ) Notice: Subject to any disclaimer, the term of this patent is extended or adjusted under 35 U.S.C. 154(b) by 209 days.

(21) Appl. No.: 12/476,331

(22) Filed: Jun. 2, 2009

(65) Prior Publication Data

US 2009/0293894 A1 Dec. 3, 2009

(30) Foreign Application Priority Data

Jun. 2, 2008 (EP) ..... 08157446

(51) Int. Cl.
*A24D 3/06* (2006.01)
*A24D 3/04* (2006.01)

(52) U.S. Cl. ..... 131/346; 131/336; 131/361

(58) Field of Classification Search ..... 131/346, 131/361, 336
See application file for complete search history.

(56) References Cited

U.S. PATENT DOCUMENTS

| | | | | |
|---|---|---|---|---|
| 884,982 | A | | 4/1908 | De Lery |
| 2,104,329 | A | | 1/1938 | Levy |
| 2,881,770 | A | | 4/1959 | Touey |
| 2,987,686 | A | | 10/1959 | Siegel |
| 3,016,945 | A | | 1/1962 | Wexler |
| 3,068,873 | A | | 12/1962 | Allman, Jr. et al. |
| 3,101,723 | A | | 8/1963 | Seligman et al. |
| 3,144,024 | A | | 8/1964 | Eichwald et al. |
| 3,162,199 | A | | 12/1964 | Moll, Jr. |
| 3,313,306 | A | | 4/1967 | Berger et al. |
| 3,339,558 | A | | 9/1967 | Waterbury |
| 3,353,543 | A | | 11/1967 | Sproull et al. |
| 3,370,592 | A | * | 2/1968 | Schultz et al. ..... 131/334 |
| 3,397,700 | A | | 8/1968 | Harlow et al. |
| 3,422,819 | A | | 1/1969 | Jones et al. |
| 3,637,447 | A | | 1/1972 | Berger et al. |
| 3,683,936 | A | | 8/1972 | O'Neil, Jr. |

(Continued)

FOREIGN PATENT DOCUMENTS

| | | |
|---|---|---|
| BE | 859399 | 4/1978 |
| CA | 1100745 | 5/1981 |

(Continued)

OTHER PUBLICATIONS

Notification of Transmittal of International Preliminary Examination Report dated Feb. 9, 2004 for PCT/US03/09648.

(Continued)

*Primary Examiner* — Richard Crispino
*Assistant Examiner* — Dionne Walls Mayes
(74) *Attorney, Agent, or Firm* — Buchanan Ingersoll & Rooney PC

(57) ABSTRACT

A smoking article includes a tobacco rod, a filter located at the mouth end of the smoking article, at least one tipping material, to attach the filter to the tobacco rod, wherein the at least one tipping material includes at least one transparent section, wherein the smoking article further includes a ventilation zone upstream of the at least one transparent section. A tipping material for such a smoking article is also disclosed.

20 Claims, 1 Drawing Sheet

U.S. PATENT DOCUMENTS

| | | | | |
|---|---|---|---|---|
| 3,779,787 | A | | 12/1973 | Haslam et al. |
| 3,837,264 | A | | 9/1974 | Sexstone |
| 3,847,064 | A | | 11/1974 | Berger |
| 3,853,039 | A | | 12/1974 | Haslam et al. |
| 3,894,545 | A | | 7/1975 | Crellin et al. |
| 3,943,941 | A | | 3/1976 | Boyd et al. |
| 4,044,777 | A | | 8/1977 | Boyd et al. |
| 4,079,742 | A | | 3/1978 | Rainer et al. |
| 4,174,719 | A | | 11/1979 | Martin et al. |
| 4,179,323 | A | | 12/1979 | Sigmon |
| 4,189,511 | A | | 2/1980 | Levers et al. |
| 4,219,031 | A | | 8/1980 | Rainer et al. |
| 4,236,532 | A | | 12/1980 | Schweizer et al. |
| 4,237,908 | A | | 12/1980 | Debrois |
| 4,256,123 | A | | 3/1981 | Lenduay et al. |
| 4,256,126 | A | | 3/1981 | Seligman et al. |
| 4,281,671 | A | | 8/1981 | Bynre et al. |
| 4,286,604 | A | | 9/1981 | Ehretsmann et al. |
| 4,291,711 | A | | 9/1981 | Berger |
| 4,355,995 | A | | 10/1982 | Berger |
| 4,481,958 | A | | 11/1984 | Rainer et al. |
| 4,522,616 | A | | 6/1985 | Hyde et al. |
| 4,537,583 | A | | 8/1985 | Pryor |
| 4,549,875 | A | | 10/1985 | Pryor |
| 4,608,999 | A | * | 9/1986 | Johnson ..... 131/336 |
| 4,655,229 | A | | 4/1987 | Sensabaugh, Jr. et al. |
| 4,661,090 | A | | 4/1987 | Arthur |
| 4,676,769 | A | | 6/1987 | Bahr et al. |
| 4,677,995 | A | | 7/1987 | Kallianos et al. |
| 4,744,932 | A | | 5/1988 | Browne |
| 4,768,526 | A | | 9/1988 | Pryor |
| 4,798,570 | A | | 1/1989 | Jurkiewitsch |
| 4,971,078 | A | | 11/1990 | Deutsch et al. |
| 5,012,829 | A | | 5/1991 | Thesing et al. |
| 5,144,967 | A | | 9/1992 | Cartwright et al. |
| 5,190,061 | A | | 3/1993 | Brackman et al. |
| 5,269,329 | A | | 12/1993 | Geer et al. |
| 5,396,909 | A | | 3/1995 | Gentry et al. |
| 5,396,910 | A | | 3/1995 | Casey, III |
| 5,404,890 | A | | 4/1995 | Gentry et al. |
| 5,415,189 | A | | 5/1995 | Sampson et al. |
| 5,568,819 | A | | 10/1996 | Gentry et al. |
| 6,202,650 | B1 | | 3/2001 | Kaneki et al. |
| 7,074,170 | B2 | | 7/2006 | Lanier, Jr. et al. |
| 2002/0153017 | A1 | | 10/2002 | Georgitsis et al. |
| 2006/0150991 | A1 | * | 7/2006 | Lee ..... 131/331 |
| 2009/0014020 | A1 | * | 1/2009 | Yoss et al. ..... 131/340 |

FOREIGN PATENT DOCUMENTS

| | | | | |
|---|---|---|---|---|
| CH | 394 912 | | | 6/1965 |
| DE | 2744728 | | | 10/1977 |
| EP | 0 505 883 | | * | 9/1992 |
| EP | 1 252 832 | A | | 10/2002 |
| FR | 2366807 | | | 10/1977 |
| GB | 1023918 | | | 3/1966 |
| GB | 1033818 | | | 6/1966 |
| GB | 1299012 | | | 12/1972 |
| GB | 1369067 | A | | 10/1974 |
| GB | 1064293 | | | 9/1980 |
| JP | 21655 | | | 10/1964 |
| JP | 23970 | | | 10/1968 |
| JP | 23980 | | | 10/1968 |
| JP | 54156057 | | * | 5/1984 |
| JP | 10-182842 | A | | 7/1998 |
| JP | 2001-120250 | A | | 5/2001 |
| WO | WO 02/069745 | A1 | | 9/2002 |
| WO | WO 03/059096 | | | 7/2003 |
| WO | WO 2004/068975 | A1 | | 8/2004 |
| WO | WO 2004/089124 | A1 | | 10/2004 |
| WO | WO 2006/082525 | A1 | | 8/2006 |
| WO | WO 2008/059377 | A2 | | 5/2008 |

OTHER PUBLICATIONS

European Search Report dated Mar. 13, 2009 in Application No. 01857446.9-2313.

Third Party Observation dated Sep. 27, 2011 for EP 09757503.9-2313.

* cited by examiner

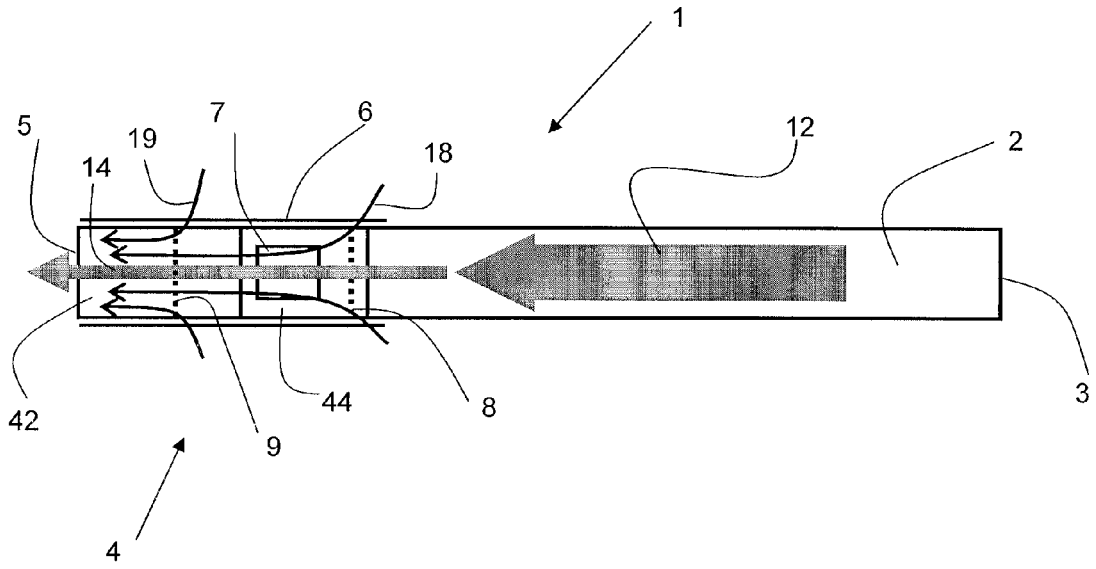
1
5
19
7
6
18
12
2
14
42
9
44
8
3
4

SMOKING ARTICLE WITH TRANSPARENT SECTION

CROSS-REFERENCE TO RELATED APPLICATION

This application corresponds to European Application No. EP 08157446, filed Jun. 2, 2008, the entire content of which is incorporated herein by this reference thereto.

BACKGROUND

Filter cigarettes typically comprise a rod of tobacco cut filler surrounded by a paper wrapper and a cylindrical filter aligned in end-to-end relationship with the wrapped tobacco rod and attached thereto by tipping paper.

Filters in conventional cigarettes may comprise one or more segments of filtration material for the removal of particulate and gaseous components of the mainstream smoke. In conventional filter cigarettes, the filter usually consists of a plug of cellulose acetate tow wrapped in porous plug wrap. From the Swiss patent CH394912 it is known to include one or more transparent sections in the tipping paper in order to render the interior of the filter cigarette at least partially visible. Unfortunately, in use, the transparent section becomes quickly opaque as particles from the mainstream smoke deposit on the inside of the transparent section. Thus, the possibility to observe the inside of the filter is quickly lost.

It would be desirable to provide a smoking article that allows viewing the inside of at least a part of the filter throughout the entire use of the smoking article.

SUMMARY OF SELECTED ASPECTS OF THE INVENTION

A smoking article includes: (a) a tobacco rod; (b) a filter located at the mouth end of the smoking article; (c) at least one tipping material to attach the filter to the tobacco rod; and (d) a ventilation zone upstream of the at least one transparent section. The at least one tipping material includes at least one transparent section.

In an embodiment, the ventilation zone is arranged circumferentially between about 3 mm and about 8 mm upstream of the at least one transparent section. The ventilation zone comprises about 25 to about 50 openings per cm in circumferential direction. The relative ventilation upstream of the at least one transparent section is about 65 percent to about 75 percent. In an embodiment, the smoking article can also include perforations downstream of the at least one transparent section.

In an embodiment, the at least one transparent section comprises colorants.

In another embodiment, the smoking article includes a total of one to five segments. Each of the one to five segments are at least one of a structural segment, a filtration segment or a flavor release segment. The at least one transparent section is positioned so as to allow the view of at least one of the functional segment, filtration segment or flavor release segment.

A tipping material for the smoking article is transparent and includes a layer of hot melt. The untreated hot melt is transparent and heat treatment renders the hot melt opaque. In one embodiment, the tipping material includes at least one area of opaque hot melt. In another embodiment, the hot melt includes colorants.

BRIEF DESCRIPTION OF THE DRAWINGS

FIG. 1 is an illustration of a smoking article having a tipping paper with at least one transparent section.

DETAILED DESCRIPTION

A smoking article, for example a filter cigarette is provided. A novel wrapper for such smoking article is also provided.

The smoking article as described herein includes a tobacco rod, a filter and at least one tipping material to attach the filter to the tobacco rod, wherein the at least one tipping material includes at least one transparent section. In an embodiment, the smoking article further includes a ventilation zone upstream of the at least one transparent section of the tipping material.

In addition to the mainstream smoke drawn through the lit end of the smoking article, ambient air is drawn through the ventilation zone upstream of the transparent section of the tipping material. It has been found, that this additional air stream of ambient air drawn through the ventilation zone upstream of the transparent section diverts the mainstream smoke past the transparent section. The diversion of the mainstream smoke significantly reduces or avoids completely the deposition of mainstream smoke particles on the inside of the transparent section. Thus, the transparent section remains clear and allows a full view of the visible filter segment throughout the use of the smoking article.

Throughout the specification, the term "tipping material" is used to describe the outermost layer of material circumscribing the filter and connecting the filter to the tobacco rod. Typically, this tipping material is air impermeable.

Throughout the specification, the term "transparent section" is used to describe any section of the tipping material that is transparent, regardless of the shape or size of the section. The transparent section may encompass a ring shaped section, one or more rectangles, triangles, circles, semi-circles, ovals, may be in the form of a logo or font, or may have any other geometrical shape. Alternatively, the entire tipping material is transparent. In that case, the ventilation zone is inside the transparent section, preferably towards the rod end of the filter. The deposition reducing effect of the ventilation zone is strongest downstream of the ventilation zone but may reach a small distance into the transparent section upstream of the ventilation zone as well.

The at least one transparent section may have a transparency between about 10 percent and about 100 percent, preferably, between about 50 and about 95 percent, more preferably between about 60 percent and about 90 percent.

Throughout the specification, the term "ventilation zone" is used to describe a designed arrangement of openings in the tipping paper that allows the controlled entry of ambient air into the smoking article. The ventilation opening may be a number of perforations, for example punched or cut mechanically, chemically, electrically or by laser perforation.

Throughout the specification, the terms "upstream" and "downstream" are used to describe the relative positions of segments of the filter in relation to the direction of the mainstream smoke drawn from a rod of smokable material through the filter segments during use. In that sense, "upstream" means towards the lit end of the smoking article, whereas "downstream" means towards the mouth end of the smoking article.

In a preferred embodiment, the ventilation zone is in the tipping material. The ventilation zone may be arranged circumferentially, helically or longitudinally in the direction of the smoking article or combinations thereof. Preferably, the ventilation zone is arranged circumferentially between about 3 mm and about 8 mm upstream of the at least one transparent section. Preferably, the ventilation zone is at least about 2 mm downstream from the downstream end of the tobacco rod, more preferably at least about 5 mm. Preferably, the ventilation zone is arranged along the circumference of the smoking article proximate to the extent of the transparent section about the circumference of the smoking article. For example, if the transparent section is a complete ring, preferably, the ventilation zone is arranged about the complete circumference of the smoking article. In that case, the ambient air streaming in from all sides into the smoking article channels the mainstream smoke along the longitudinal axis in the center of the smoking article. In this arrangement, the particles from the channeled mainstream smoke will rarely deposit on the inside of the transparent section. If, for example, the transparent section is arranged about half of the circumference of the smoking article, preferably, the ventilation zone is at least arranged about the same half of the circumference of the smoking article. In this case the ambient air entering into the smoking article through the ventilation zone diverts the mainstream smoke to the opposite half of the filter segment comprising the transparent section. Again, particles from the mainstream smoke will rarely deposit on the transparent section.

Preferably, the number of openings in the ventilation zone is between about 25 per cm and about 50 per cm in circumferential direction. This allows for a sufficient stream of ambient air to enter into the smoking article upstream of the transparent section.

Preferably, the ventilation zone is arranged in one to four lines around the circumference of the smoking article.

In the case, where the tipping material includes multiple transparent sections, preferably, a ventilation zone is arranged upstream of all transparent sections. Alternatively or in addition, a ventilation zone may be upstream of each of the multiple transparent sections in the tipping material.

In a further embodiment of the smoking, the filter includes a further ventilation zone downstream of the transparent section. While this further ventilation zone contributes little to avoid the deposition of particles on the inside of the transparent section, it may be used to achieve a desired overall ventilation of the smoking article.

Preferably, the overall ventilation of the smoking article is between about 20 percent and 95 percent. More preferably, the overall ventilation of the smoking article is between about 50 percent and about 90 percent. It has been found, that a relative ventilation upstream of the transparent section of about 70 percent is particularly suitable to avoid deposition of particles on the inside of the transparent section. If a smoking article has additional ventilation zones downstream of the transparent section, preferably, the relative ventilation upstream of the transparent section is between about 65 percent and about 75 percent. Preferably, the relative ventilation upstream of the transparent section is about 1.2 to about 5 times higher than the relative ventilation downstream of the transparent section.

In an embodiment, the at least one transparent section includes colorants. Preferably, the colorants have a light hue to ensure a sufficient transparency, for example yellow, light blue, orange, pink, light brown, light green or light purple. Alternatively or in addition, the transparent section may have a repetitive or non-repetitive pattern like lines, diamonds, logos, text, flowers, waves, or other undulations in longitudinal, spiral or circumferential direction. Preferably, the colorants are embedded in the tipping material, that is, the colorants are added to the tipping material during the manufacturing process of the tipping material, for example during paper manufacture. Alternatively, the colorants may be printed on one or two sides of the tipping material by a suitable printing process, for example offset printing or gravure printing.

Preferably, the tipping material is coated by a varnish at the mouth end to simulate the surface structure of standard tipping paper.

Preferably, the filter includes one to five segments. Preferably, the transparent section or sections allow the view inside at least parts of one, two, three, four or all segments.

In filters with two or more segments, the segment closest to the tobacco rod is referred to as rod end segment. The filter segment closest to the mouth end of the smoking article is referred to as mouth end segment.

Preferably, each of the one to five segments is at least in one of the segment categories of a structural segment, a filtration segment or a flavor release segment. A segment of the filter may be in two or in all segment categories. For example, a segment of the filter may be a cavity (structure category) filled halfway with carbon (filtration category) and filled halfway with flavor loaded cellulosic particles (flavor release category).

Preferably, the functional segment includes at least one of a recess, a cavity or a restrictor.

In smoking articles described herein, the mouth end segment of the filter may include a hollow tube or recess. The hollow tube or recess may be formed when the filter is attached to a rod of smokable material by, for example, tipping paper to form a smoking article. Preferably, the recess further includes a cylindrical element that adds structural strength to the tube, for example a paper or carton tube that is overwrapped by the tipping material. Recess filters are well known in the art, for example, in European patent application EP-A-1610632 and British patent application GB-A-1299012.

In smoking articles as described herein, the filter may include a cavity segment. A cavity segment is an empty space or void inside the filter. The cavity may be filled with flavoring or filtering material or other functional elements. Preferably, the cavity is completely filled. The complete filling of the cavity adds structural strength to this filter segment. Preferably, the ventilation zone is not in the area of a cavity segment. Cavity segments in filters are well known in the art, for example, in the European patent applications EP-A-1377184, EP-A-1474008 and EP-A-1848292.

In smoking articles as described herein, the filter may include a restrictor segment. A restrictor segment affects the resistance to draw and other fluid dynamics of the smoking article and also affects the formation of carbon monoxide and carbon dioxide. Restrictors in smoking articles are known in the art, for example from the International patent application PCT/IB2007/004224. Preferably, the restrictor is at least partially visible through the transparent section.

Preferably, the filtration segment includes at least one of: filter tow material or sorbents such as for example, carbon, carbon beads or a carbon structure, activated carbon, active aluminium, zeolites, sepiolites, molecular sieves and silica gel. The filtration material in the filtration segment is useful for the removal of particulate and gaseous components of the mainstream smoke. A carbon structure is known in the art, for example in the form of an extruded carbon honeycomb structure. Such a carbon structure is disclosed for example in the Japanese patent application JP-A 2001-120250.

Preferably, the filtration segment is at least partially visible through the transparent section.

Preferably, the flavor release segment includes at least one of plant leaf, tobacco beads, flavor loaded cellulose beads, one or more flavor containing capsules or flavored threads.

Preferably, the flavor release segment is at least partially visible through the transparent section.

The term "plant leaf" is used to denote a material consisting of the leaves of a plant, which have preferably been cut or shredded to provide a particulate material.

The flavor release segment may include any plant leaf that is capable of releasing flavor into mainstream smoke drawn through the filter segment.

The plant leaf in the flavor release segment may be distributed through a plug of fibrous filtration material, preferably a cellulose acetate tow.

The flavor release segment may include one or more flavorants, preferably one or more liquid flavorants, to further enhance flavor delivery to the consumer during smoking.

For example, the rod end segment may include a plug of filtration material including one or more threads impregnated with liquid flavorant. The threads may be colored, for example, to indicate the type of flavorant impregnated therein. Filter plugs comprising flavorant bearing threads suitable for use in rod end segments of filters described herein, and methods and apparatuses for producing such plugs, are described in U.S. Pat. Nos. 4,281,671 and 7,074,170 and are available from the American Filtrona Company, Richmond, Va., USA.

Alternatively, the filter segment may include a plurality of beads impregnated with liquid flavorant. The beads may be formed from, for example, a cellulosic material bonded with a polyvinyl acetate binder, or from tobacco powder bonded with microcrystalline cellulose. Beads suitable for use in filter segments of filters described herein are manufactured and sold under the brand Viscopearls® by Rengo Co. Ltd., Japan. Methods and apparatuses for producing such beads are also described in Japanese Patent Application No. 10182842.

Many combinations of the above described functional segments, filtration segments and flavor release segments are possible, including combinations with a different sequence of filter segments in a downstream direction.

A particularly advantageous tipping material and method of manufacture to produce opaque and transparent sections in the tipping material is also provided.

In an embodiment, a tipping material for a smoking article is provided, wherein the tipping material is transparent and includes a layer of hot melt, wherein the untreated hot melt is transparent and wherein heat treatment renders the hot melt opaque. Hot melt is commonly used to attach the tipping material to the filter segments and the tobacco rod. In an embodiment, the hot melt may be additionally used to change the transparency of the tipping material and thus to create tipping material that has transparent and opaque sections. This way, the hot melt, which is required to attach the filter to the tobacco rod is used in a double function to structure the transparency of the tipping material at the same time.

Preferably, the hot melt is activated in a temperature range between about 60 and about 120 degrees Celsius, preferably about 80 degrees Celsius. Preferably, the activation of the hot melt to render the hot melt opaque is performed in a filter tipping device. Preferably, the hot melt is activated before the tipping material is cut into single pieces for each smoking article. Preferably, all the hot melt on the tipping material is activated.

Preferably, the hot melt is applied to the tipping material in a gravure printing process. This allows for the easy formation of transparent and opaque sections on the tipping material, for example basic geometrical shapes, font and logos. Alternatively, the hotmelt is applied to the tipping paper in a continuous layer and the hot melt is selectively activated, for example by infrared radiation.

Preferably, colorants are added to the hot melt in order to change the color of the tipping material when the hot melt is applied. Preferably, the overall length of smoking articles described herein is between about 70 mm and about 128 mm, more preferably about 84 mm.

Preferably, the external diameter of filters and smoking articles described herein is between about 3 mm and 8.5 mm, more preferably about 7.9 mm.

Preferably, the overall length of filters for use in the smoking articles is between about 18 mm and about 36 mm, more preferably about 27 mm.

Preferably, the length of each individual segment of filters for use in the smoking articles is between about 5 mm and about 22 mm.

Filters for use in the smoking articles may be produced by forming separate continuous rods comprising multiple units of each individual segment of the filter. Then these separate rods are combined in a known manner in one or more stages to form a continuous filter rod comprising multiple units of the filter. The continuous filter rod may then be subsequently severed at regular intervals by a cutting mechanism to yield a succession of discrete filters.

Preferably, smoking articles include a wrapped rod of tobacco cut filler.

Preferably, smoking articles have a total nicotine free dry particulate matter (NFDPM) or "tar" delivery of up and about 10 mg. More preferably, the "tar delivery" is between 1 mg and 10 mg and more preferably about 6 mg.

Smoking articles may be packaged in containers, for example in soft packs or hinge-lid packs, with an inner liner coated with one or more flavorants.

By way of example only, with reference to the accompanying FIG. 1 that shows a side view of a filter cigarette and the airflow inside the cigarette.

FIG. 1 illustrates the air diversion mechanism of the ambient air 18 drawn through the ventilation zone 8. The filter cigarette 1 includes an elongated, cylindrical wrapped tobacco rod 2 attached at one end to an axially aligned, elongated, cylindrical, filter 4. The wrapped tobacco rod 2 and the filter 4 are joined in a conventional manner by tipping paper 6, which circumscribes the entire length of the filter 4 and an adjacent portion of the wrapped tobacco rod 2. The filter 4 shown in FIG. 1 includes a mouth send segment 42 and a rod end segment 44. The tipping paper 6 has a transparent, rectangular window 7 that provides a view of the inside of the filter 4, particularly of the rod end filter segment 44. Ventilation zone 8 in the tipping paper 6 are arranged upstream of the transparent section 7. Additional perforations 9 are arranged in the tipping paper 6 downstream of the transparent section 7.

In use, a negative pressure applied at the mouth end 5 of the smoking article 1 draws mainstream smoke 12 from the lit end 3 towards the filter 4. Additionally, ambient air 18 is drawn through the ventilation zone 8 upstream of the transparent section 7 of the tipping material 6. Further downstream, additional ambient air 19 joins the diluted mainstream smoke 14 through the perforations 9.

The ambient air 18 forms an air cushion between the mainstream smoke 12 and the transparent section 7, such that the diluted mainstream smoke 14 is channeled along the center axis of the filter past the transparent section 7. The air cushion limits the particles in the mainstream smoke 12 that are deposited on the transparent section 7.

FIG. 1 shows, two filter segments 42, 44 are shown in abutting end-to-end relationship. Typically, the mouth end segment 42 comprises a plug of cellulose acetate tow of low filtration efficiency plasticized with glycerol triacetate. The rod end segment 44 is a flavor release segment, for example comprising a plug of cellulose acetate tow with dried tobacco leaf.

In an alternative embodiment (not shown), the mouth end segment of the filter shown in FIG. 1 is replaced by a recess, which has substantially no filtration efficiency, formed by the tipping paper and a carton tube to provide sufficient strength.

Alternatively, the mouth end segment of the filter cigarette further includes a central cotton thread (not shown) loaded with menthol that extends axially through the plug of cellulose acetate tow, parallel to the longitudinal axis of the filter cigarette.

Alternatively, the filter includes three segments (not shown) in abutting end-to-end relationship: a mouth end segment, distant from the tobacco rod; a flavor release segment located upstream of the mouth end segment; and a rod end segment, located upstream of the flavor release segment and adjacent to and abutting the wrapped tobacco rod. The mouth end segment is of the same or different construction as those previously described for the filter cigarette 1 shown in the FIGURE. The flavor release segment may be for example a cavity filled with flavor loaded cellulosic beads or a breakable capsule containing a liquid flavorant. In this embodiment, the rod end segment includes a plug of cellulose acetate tow of medium to high filtration efficiency, which, in use, partially filters out particulate phase components of the mainstream smoke.

In alternative embodiments (not shown), the rod end segments of the filters of the filter cigarette shown in the FIGURE may further include at least one sorbent capable of removing gas phase constituents from mainstream smoke drawn through the filters. The at least one sorbent is, for example, activated carbon, activated aluminum, zeolites or sepiolites provided on the cellulose acetate tow.

Alternatively, the filter cigarette comprises a filter that includes four segments (not shown) in abutting end-to-end relationship: a mouth end segment, distant from the tobacco rod; a first flavor release segment located upstream of the mouth end segment, a second flavor release segment located upstream of the first flavor release segment; and a rod end segment, located upstream of the second flavor release segment and adjacent to and abutting the wrapped tobacco rod. The mouth end segment, the second flavor release segment and the rod end segment may be of the same or different construction as the mouth end segment, the flavor release segment and the rod end segment previously described. The second flavor release segment comprises a plug of densely packed fine cut tobacco.

To form the filter cigarette according to the embodiments disclosed herein and shown in FIG. 1, the filters are produced and then joined to the wrapped tobacco rods. The tobacco rods, which are produced in a conventional manner, by the tipping paper using known filter cigarette making equipment.

To produce each filter, separate continuous rods including multiple units of each segment of the filter are produced in a known manner and then combined to form a continuous filter rod comprising multiple units of the filter. The continuous filter rod is then severed at regular intervals by a cutting mechanism to yield a succession of discrete filters.

In this specification, the word "about" is often used in connection with numerical values to indicate that mathematical precision of such values is not intended. Accordingly, it is intended that where "about" is used with a numerical value, a tolerance of ±10% is contemplated for that numerical value.

While the foregoing describes in detail a preferred smoking article with transparent section and methods of making with reference to a specific embodiment thereof, it will be apparent to one skilled in the art that various changes and modifications may be made to the smoking article and equivalents method may be employed, which do not materially depart from the spirit and scope of the invention. Accordingly, all such changes, modifications, and equivalents that fall within the spirit and scope of the invention as defined by the appended claims are intended to be encompassed thereby.

We claim:

1. A smoking article comprising:

a tobacco rod;

a filter located at the mouth end of the smoking article;

at least one tipping material to attach the filter to the tobacco rod, said at least one tipping material comprising at least one transparent section; and a ventilation zone upstream of the at least one transparent section, the ventilation zone configured to direct mainstream smoke along a center axis of the filter past the transparent section so as to limit deposits of particulate matter from the mainstream smoke on the at least one transparent section, wherein the at least one transparent section extends at least partially about a circumference of the filter and the ventilation zone is arranged about the circumference of the filter proximate to the extent of the transparent section about the circumference of the filter.

2. The smoking article according to claim 1, wherein relative ventilation upstream of the at least one transparent section is about 50 percent to about 90 percent.

3. The smoking article according to claim 1, wherein the relative ventilation upstream of the transparent section is about 1.2 to about 5 times higher than the relative ventilation downstream of the transparent section.

4. The smoking article according to claim 1, wherein the at least one transparent section is a single transparent section which extends only partially about the circumference of the filter.

5. The smoking article according to claim 1, wherein the at least one transparent section is a single transparent section which extends completely about the circumference of the filter.

6. A smoking article comprising:

a tobacco rod;

a filter located at the mouth end of the smoking article;

at least one tipping material to attach the filter to the tobacco rod, said at least one tipping material comprising at least one transparent section and at least one opaque section of a hot melt material that is opaque after heat treatment; and a ventilation zone upstream of the at least one transparent section, the ventilation zone configured to direct mainstream smoke along a central axis of the filter past the transparent section so as to limit deposition of particulate matter from the mainstream smoke on the at least one transparent section, wherein the at least one transparent section extends at least partially about a circumference of the filter and the ventilation zone is arranged about the circumference of the filter proximate to the extent of the transparent section about the circumference of the filter.

7. The smoking article according to claim 6, wherein the ventilation zone is arranged circumferentially between about 3 mm and about 8 mm upstream of the at least one transparent section.

8. The smoking article according to claim 7, wherein the ventilation zone comprises about 25 to about 50 openings per cm in circumferential direction.

9. The smoking article according to claim 1, wherein the relative ventilation upstream of the at least one transparent section is about 65 percent to about 75 percent.

10. The smoking article according to claim 1, wherein the at least one transparent section comprises colorants.

11. The smoking article according to claim 1, wherein the smoking article comprises a total of one to five filter segments.

12. The smoking article according to claim 11, wherein each of the one to five segments is at least one of a structural segment, a filtration segment or a flavor release segment.

13. The smoking article according to claim 12, wherein the at least one transparent section is positioned so as to allow the view of at least one of the functional segment, filtration segment or flavor release segment.

14. The smoking article according to claim 1, wherein the smoking article comprises perforations downstream of the transparent section.

15. The smoking article according to claim 1, wherein the at least one tipping material comprises a layer of hot melt, wherein the untreated hot melt is transparent and wherein heat treatment renders the hot melt opaque.

16. The smoking article according to claim 15, wherein the hot melt comprises colorants.

17. The smoking article according to claim 6, wherein relative ventilation upstream of the at least one transparent section is about 50 percent to about 90 percent.

18. The smoking article according to claim 6, wherein the relative ventilation upstream of the transparent section is about 1.2 to about 5 times higher than the relative ventilation downstream of the transparent section.

19. The smoking article according to claim 6, wherein the at least one transparent section is a single transparent section which extends only partially about the circumference of the filter.

20. The smoking article according to claim 6, wherein the at least one transparent section is a single transparent section which extends completely about the circumference of the filter.

* * * * *